United States Patent [19]

Hayashi

[11] Patent Number: 4,538,554

[45] Date of Patent: Sep. 3, 1985

[54] ARRANGEMENT OF BOILING LIQUID COOLING SYSTEM OF INTERNAL COMBUSTION ENGINE

[75] Inventor: Yoshimasa Hayashi, Kamakura, Japan

[73] Assignee: Nissan Motor Co., Ltd., Yokohama City, Japan

[21] Appl. No.: 595,524

[22] Filed: Mar. 30, 1984

[30] Foreign Application Priority Data

Apr. 13, 1983 [JP] Japan ..... 58-63788

[51] Int. Cl.[3] ..... F01P 9/02

[52] U.S. Cl. ..... 123/41.21

[58] Field of Search ..... 123/41.11, 41.12, 41.2, 123/41.21, 41.24, 41.27, 41.44, 41.51–41.54; 340/59; 73/304 R

[56] References Cited

U.S. PATENT DOCUMENTS

| | | | |
|---|---|---|---|
| 1,709,863 | 4/1929 | Modine | 123/41.26 |
| 1,735,613 | 11/1929 | Kaye | 123/41.21 |
| 1,801,086 | 4/1931 | Jahnke et al. | 123/41.33 |
| 1,806,382 | 5/1931 | Barlow | 123/41.54 |
| 2,292,946 | 8/1942 | Karig | 123/41.2 |
| 3,082,753 | 3/1963 | Bullard | 123/41.54 |
| 4,367,699 | 6/1983 | Evans | 123/41.23 |

FOREIGN PATENT DOCUMENTS

| | | |
|---|---|---|
| 638533 | 5/1928 | France . |
| 1401810 | 4/1965 | France . |

*Primary Examiner*—William A. Cuchlinski, Jr.

*Attorney, Agent, or Firm*—Schwartz, Jeffery, Schwaab, Mack, Blumenthal & Evans

[57] ABSTRACT

An improved arrangement of boiling liquid cooling system of an internal combustion engine in an engine room of a wheeled motor vehicle is disclosed. The condenser is mounted over and carried by the engine proper through a rigid bracket member.

7 Claims, 1 Drawing Figure

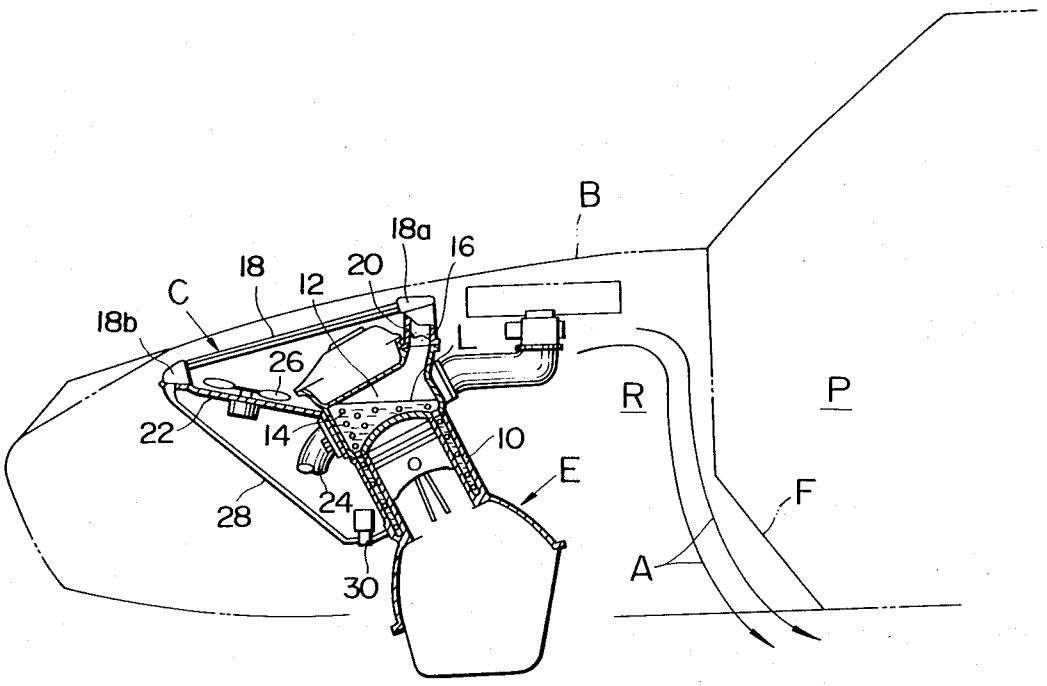
P
F
A
R
B
E
10
L
16
18a
20
12
26
18
C
18b
22
14
24
28
30

ARRANGEMENT OF BOILING LIQUID COOLING SYSTEM OF INTERNAL COMBUSTION ENGINE

BACKGROUND OF THE INVENTION

1. Field of the Invention

The present invention relates in general to a cooling system for an internal combustion engine, and particularly to a boiling liquid cooling system. More particularly, the present invention is concerned with a boiling liquid cooling system for an engine mounted in an engine room of a wheeled motor vehicle.

2. Description of the Prior Art

It has been previously proposed to cool internal combustion engines by using a boiling liquid cooling system (viz., an evaporative cooling system). As will become apparent as the description proceeds, this type of cooling system basically features an arrangement wherein a liquefied coolant in the coolant jacket of the engine is permitted to boil, and the gaseous coolant thus produced is passed out to an air-cooled heat exchanger or condenser, wherein the coolant is condensed or liquefied and then recirculated back into the coolant jacket of the engine. Due to the effective heat exchange carried out between the gaseous coolant in the condenser and the atmosphere, the cooling system exhibits a very high performance.

Because of the above-mentioned outstanding performance, it has been proposed to utilize such a boiling liquid-cooled engine in a wheeled motor vehicle as its prime mover. However, as these types of cooling systems have, for various reasons, not met with any commercial success, the layout or arrangement of such systems in an engine room has not been the subject of any substantial degree of consideration.

SUMMARY OF THE INVENTION

It is therefore an object of the present invention to provide an improved layout or arrangement of a boiling liquid cooling system in an engine room of a wheeled motor vehicle.

According to the present invention, there is provided, in a motor vehicle having an internal combustion engine mounted in an engine room thereof, a boiling liquid cooling system for cooling the engine by using a latent heat of coolant, which system comprises means defining in the engine proper a coolant jacket containing therein a liquefied coolant leaving an unoccupied space at the upper portion thereof, thereby to form a coolant level therein, a rigid conduit member securedly mounted on the engine proper and extending upwardly from the unoccupied space of the coolant jacket, a condenser having an inlet connected to the leading end of the first conduit member and an outlet positioned lower than the inlet, conduit means extending from the outlet of the condenser to the coolant jacket of the engine proper, and a rigid bracket member extending from the engine proper to support thereon the condenser.

BRIEF DESCRIPTION OF THE DRAWING

Other objects and advantages of the present invention will become apparent from the following description, when taken in conjunction with the accompanying single drawing which shows an improved arrangement of a boiling liquid cooling system of an internal combustion engine mounted in an engine room of a wheeled motor vehicle.

DETAILED DESCRIPTION OF THE INVENTION

Referring to the single drawing, there is shown an improved arrangement of the boiling liquid cooling system C according to the present invention. As is shown in the drawing, the engine E is transversely mounted in the engine room R of the vehicle body, and inclined forwardly with respect to the vehicle body. Designated by reference mark F is a fire board by which the engine room R and the passenger cabin P are bounded in a known manner.

The boiling liquid cooling system C of this invention comprises a coolant jacket formed in the engine proper E. The coolant jacket 10 has at its upper section an enlarged portion 12 merged therewith. The coolant jacket 10 contains therein a liquefied coolant 14 (for example, water), leaving an unoccupied space at the upper portion of the enlarged portion 12. The extremely heated wall portions, such as the wall portions defining the combustion chambers, the cylinders and the exhaust ports, are sufficiently submerged in the coolant 14. Designated by reference mark L is the level of the liquefied coolant 14 in the enlarged jacket portion 12. A rigid short conduit member 16 is securedly connected to the outlet of the enlarged jacket portion 12 and extends therefrom upward to an upper tank 18*a* of a condenser 18. A vapor-liquid separator 20 is mounted in the conduit member 16. The condenser 18 is tightly mounted to the engine proper E through a rigid bracket 22. As shown, the condenser 18 is slightly inclined with respect to the longitudinal axis of the vehicle body so that the outlet (viz., lower tank 18*b*) of the condenser 18 is positioned lower than the upper tank 18*a*. The bracket 22 has one end bolted, together with an exhaust manifold 24, to the engine proper E, and the other end tightly supporting thereon the lower tank 18*b* of the condenser 18. An electric fan 26 is mounted on the bracket 22, which produces an air flow passing through the condenser 18 when energized. Extending obliquely downwardly from the lower tank 18*b* of the condenser 18 is a pipe 28 of relatively small diameter which leads to a lower portion of the coolant jacket 10 of the engine proper E. An electric pump 30 is mounted to the pipe 28, which pumps up the liquefied coolant in the condenser lower tank 18*b* into the coolant jacket 10 when energized. Although not shown in the drawing, a known electric control means is associated with the electric pump 30 so that, under operation of the engine E, the pump 30 operates in a manner to keep the coolant level L in the coolant jacket 12 constant.

In operation, the coolant 14 in the coolant jacket 10 is permitted to boil and the gaseous coolant thus produced passes out through the tube 14 to the condenser 18 where the gaseous coolant is cooled and thus liquefied. The vapor-liquid separator 20 in the conduit 16 traps the liquid-state coolant and returns the same back into the jacket 12. During the condensation of the coolant in the condenser 18, the coolant removes a large amount of heat thereby allowing this cooling system to have a high cooling efficiency. Subsequent to the condensation, the liquefied coolant is recirculated back into the coolant jacket 10 of the engine E through the pipe 28 with aid of the electric pump 30.

In order to show the excellent cooling efficiency of the above-mentioned cooling system C, the coolant flow rate required for achieving a sufficient cooling of the engine E will be considered with respect to a 1.8 liter gasoline internal combustion engine under full throttle operation (viz., about 6000 rpm). Under this condition, the engine requires removal of heat of about 500 Kcal/min. Thus, when water is used as the coolant, the required coolant flow rate is about 0.93 Kg/min which is calculated by the following equation:

$$\text{Required coolant flow rate} = \frac{500\ \text{Kcal/min}}{540\ \text{Kcal/Kg}} \quad (1)$$

wherein: 540 Kcal/Kg is the evaporation latent heat of water used.

For comparison, consideration will be made to a conventional liquid water cooling system having an average radiator which shows, under the same load, about 82° C. of water temperature at its inlet and about 78.5° C. at its outlet. In this case, the required coolant flow rate is about 143 Kg/min which is calculated by the following equation:

$$\text{Required coolant flow rate} = \frac{500\ \text{Kcal/min}}{1\ \text{cal/gr. C.}^\circ \times (82\text{–}78.5)\text{C.}^\circ} \quad (2)$$

wherein: 1 cal/gr.C.° is the specific heat of water used.

It is to be noted that the flow rate 0.93 Kg/min in the boiling liquid cooling system C is much smaller than the 143 Kg/min of the conventional liquid water cooling system This excellent cooling efficiency of the boiling liquid cooling system C allows a reduction in size and weight of the condenser practically used therein.

In the following, advantageous features of the present invention will be described.

The condenser 18 is tightly mounted over and supported by the engine proper E through the bracket 22. This arrangement is permitted due to the considerable reduction in size and weight of the condenser 18. Thus, according to the present invention, the engine E and the cooling system C can be compactly combined without requiring a substantial narrowing of the engine room R. That is to say, enlargement of the passenger cabin P can readily be accomplished in the invention. Furthermore, positioning the condenser 18 at the upper portion as proposed by the invention brings about another advantage in that, at the vehicle cruising speed, the heated air having just passed through the condenser 18 does not blow against the engine proper E, but flows horizontally rearwardly toward the fire board F and escapes to the outside through the open bottom of the engine room R in a manner as indicated by the arrows A. Thus, the cooling effect provided by the cooling system C is substantially fully used for engine cooling. If desired, ventilation openings may be provided at the rear portion of the engine room hood B in order to promote ventilation.

What is claimed is:

1. In a motor vehicle having an internal combustion engine mounted in an engine room thereof, a boiling liquid cooling system for cooling the engine by using a latent heat of coolant, comprising:

means defining in the engine proper a coolant jacket into which the coolant is introduced in liquid state and from which the coolant is discharged in gaseous state, said coolant jacket containing therefore liquid state coolant therein under operation of the engine leaving an unoccupied space at the upper portion thereof thereby to form a coolant level therein;

a rigid conduit member securedly mounted on the engine proper and extending upwardly from said unoccupied space of the coolant jacket;

a condenser having an inlet connected to the leading end of said rigid conduit member and an outlet positioned lower than said inlet, said condenser being mounted over the engine proper;

a conduit member extending downwardly from said outlet of the condenser to said coolant jacket at a position lower than said coolant level;

a pump mounted to said conduit member for pumping the liquefied coolant from the condenser into said coolant jacket below the coolant level; and a rigid bracket member extending from the engine proper to support thereon said condenser.

2. A boiling liquid cooling system as claimed in claim 1, in which said rigid bracket member has one end bolted to the engine proper and the other end tightly supporting thereon a lower tank of said condenser.

3. A boiling liquid cooling system as claimed in claim 2, in which the end of the rigid bracket member is bolted to the engine proper together with an exhaust manifold of the engine.

4. A boiling liquid cooling system as claimed in claim 3, in which the condenser is inclined with respect to a horizontal member of the vehicle body.

5. A boiling liquid cooling system as claimed in claim 1, further comprising an electric fan which is mounted to said rigid bracket member to produce an air flow passing through the condenser.

6. A boiling liquid cooling system as claimed in claim 5, further comprising an electric pump which is mounted to said conduit means to pump up the liquefied coolant in the condenser into said coolant jacket.

7. A boiling liquid cooling system as claimed in claim 6, further comprising a vapor-liquid separator mounted in the rigid conduit member.

* * * * *